US009308626B2

(12) United States Patent
Chuang

(10) Patent No.: US 9,308,626 B2
(45) Date of Patent: Apr. 12, 2016

(54) CLAMP WITH RATCHET DEVICE

(71) Applicant: EHOMA INDUSTRIAL CORPORATION, Taichung (TW)

(72) Inventor: Chun-Huan Chuang, Taichung (TW)

(73) Assignee: EHOMA INDUSTRIAL CORPORATION, Taichung (TW)

( * ) Notice: Subject to any disclaimer, the term of this patent is extended or adjusted under 35 U.S.C. 154(b) by 113 days.

(21) Appl. No.: 14/444,870

(22) Filed: Jul. 28, 2014

(65) Prior Publication Data

US 2016/0023330 A1 Jan. 28, 2016

(51) Int. Cl.

| | |
|---|---|
| ***B25B 5/10*** | (2006.01) |
| ***B25B 5/16*** | (2006.01) |
| ***B25B 13/46*** | (2006.01) |

(52) U.S. Cl.

CPC . *B25B 5/101* (2013.01); *B25B 5/16* (2013.01); *B25B 13/46* (2013.01)

(58) Field of Classification Search

CPC ..... B25B 13/22; B25B 13/46; B25B 13/463; B25B 5/00; B25B 5/06; B25B 5/067; B25B 5/10; B25B 5/101; B25B 5/16

See application file for complete search history.

(56) References Cited

U.S. PATENT DOCUMENTS

| | | | | | |
|---|---|---|---|---|---|
| 2,316,073 | A * | 4/1943 | Kellogg | B25B 5/082 | 24/524 |
| 2,463,263 | A * | 3/1949 | Gordon | B25B 5/101 | 269/182 |
| 2,733,623 | A * | 2/1956 | Timmons | B25F 1/00 | 81/60 |
| 2,768,664 | A * | 10/1956 | Morgan | B25B 1/125 | 269/146 |
| 3,066,931 | A * | 12/1962 | Beals | B25B 1/125 | 269/173 |
| 3,621,739 | A * | 11/1971 | Seablom | B25B 13/462 | 192/44 |
| 4,185,811 | A * | 1/1980 | Long | B25B 5/06 | 269/216 |
| 4,893,801 | A | 1/1990 | Flinn | | |
| 6,089,556 | A | 7/2000 | Whiteford | | |
| 6,708,966 | B1 | 3/2004 | Troudt | | |
| 6,981,434 | B2 * | 1/2006 | Chen | B25B 13/463 | 192/43.1 |
| 7,124,664 | B1 * | 10/2006 | Lee | B25B 13/463 | 192/43.1 |
| 7,530,556 | B1 | 5/2009 | Zheng | | |
| 7,921,751 | B2 * | 4/2011 | Hu | B25B 13/463 | 81/63.1 |
| 7,987,747 | B2 * | 8/2011 | Ross | B25B 13/463 | 81/62 |
| 8,025,275 | B2 | 9/2011 | Wong | | |
| 8,025,279 | B2 | 9/2011 | Seber | | |
| 2008/0141831 | A1 * | 6/2008 | Ekola | B25B 7/123 | 81/9.3 |
| 2009/0014934 | A1 * | 1/2009 | Seber | B25B 5/101 | 269/207 |
| 2009/0193945 | A1 * | 8/2009 | Verbowski | B25B 5/101 | 81/484 |
| 2011/0197717 | A1 * | 8/2011 | Huang | B25B 13/08 | 81/58.2 |
| 2013/0291688 | A1 * | 11/2013 | Hu | B25B 13/463 | 81/63.1 |

* cited by examiner

*Primary Examiner* — Lee D Wilson
*Assistant Examiner* — Tyrone V Hall, Jr.
(74) *Attorney, Agent, or Firm* — Muncy, Geissler, Olds & Lowe, P.C.

(57) ABSTRACT

A clamp with ratchet device for clamping a target object includes a clamp body, a thread rod, a clamping member, and a ratchet device. Therein, the clamp body has a fixed part and an installation part. The thread rod is movably disposed on the installation part and having a first end and a second end. The clamping member is disposed on the second end of the thread rod. The ratchet device is combined to a first end of the thread rod and operated between an idling position and a driving position. The ratchet device is able to drive the thread rod to rotate and move toward and away from the fixed part at the driving position and idle against the thread rod at the idling position. Therefore, the clamp is allowed to be operated in a narrow space.

25 Claims, 8 Drawing Sheets

CLAMP WITH RATCHET DEVICE

BACKGROUND OF THE INVENTION

1. Field of the Invention The present invention relates to clamps, and more particularly, to a clamp with ratchet device.

2. Description of the Related Art

A clamp usually has a configuration including a fixed part and an active part, wherein the active part is allowed to be moved toward or away from the fixed part, thereby clamping a target object and achieving different operational demands.

U.S. Pat. No. 8,025,275 discloses a single hand operated ratchet clamp, comprising a slide rail, a sliding arm, a fixed arm, a lever element, and a pressure plate. When clamping an object, user grips the slide rail with one hand and uses the lever element to move the sliding arm toward the fixed arm with the other hand. When the target object is to be clamped, through deflecting the lever element, the pressure plate rapidly pushes and presses the target object, achieving a one-hand operation. However, when the pressure plate pushes and presses the target object, the user is unable to make the pressure plate further exert additional pressure upon the target object through the lever element, failing to meet the requirement of tightly and stably clamping the target object.

U.S. Pat. No. 8,025,279 also discloses a ratcheting C-clamp, comprising a main body, a threaded rod, an actuator, a ratchet mechanism, and a gear assembly. The thread rod is movably connected to the main body, and the actuator is mechanically connected to the thread rod through the ratchet mechanism, whereby the thread rod is able to axially move toward or away from a target object. Furthermore, the ratchet mechanism is further connected to the thread rod through the gear assembly which comprises external teeth that couple to external threads on the rod. Therefore, with the actuator as a handgrip, user is able to make the thread rod move toward or away from the target object by operating the handgrip with only one hand. However, the rod needs to be rotated by the lever on one end of the rod, whereby the clamping force of the C-clamp is exerted upon the target object, facilitating the mechanical operation of the clamp and stably clamping the target object on the main body. However, in a narrow operational environment, exerting the clamping force by use of the lever is inconvenient, and the clamping force exerted might be insufficient. Also, an exposed spring is disposed between the handle and the main body; as a result, other objects may be accidentally hooked, causing the handle to be malfunctioned.

SUMMARY OF THE INVENTION

For improving issues aforementioned, the present invention discloses a clamp with ratchet device, wherein a thread rod thereof reciprocates through a ratchet device, whereby the clamp is allowed to be operated in a narrow space for clamping a target object.

The present invention provides a clamp with ratchet device for clamping a target object, comprising:

a clamp body, provided with a fixed part and a corresponding installation part;

a thread rod, movably disposed on the installation part and having a first end and a second end;

a clamping member, disposed on the second end of the thread rod; and a ratchet device, combined to a first end of the thread rod, and being operated between an idling position and a driving position, wherein the ratchet device is able to drive the thread rod to rotate and move toward and away from the fixed part at the driving position, or otherwise idle against the thread rod at the idling position.

With such configuration, the clamp is allowed to be operated in a narrow space.

Further, the ratchet device of the present invention is provided with a main body. The main body has a head part and a grip part extending from the head part. The first end of the thread rod has a ratchet part, while the main body is pivotally provided with a ratchet block for engaging the ratchet part. Also, the ratchet block is allowed to swing between a first position and a second position, facilitating the ratchet device being operated between the idling position and the driving position.

Further, the ratchet device has a positioning mechanism for positioning the ratchet block at the first position and the second position, while the positioning mechanism comprises a pushing member resiliently pushing the ratchet block, whereby the ratchet block is optionally positioned at the first position or the second position.

Therefore, user operates the ratchet device for driving the thread rod to reciprocate, facilitating the usage of the present invention in a narrow space. Also, during the driving process, force is efficiently exerted on the thread rod for enhancing the clamping effect, providing an acceleration of operation and an easiness of force exertion.

DETAILED DESCRIPTION OF THE INVENTION

Figure 1:
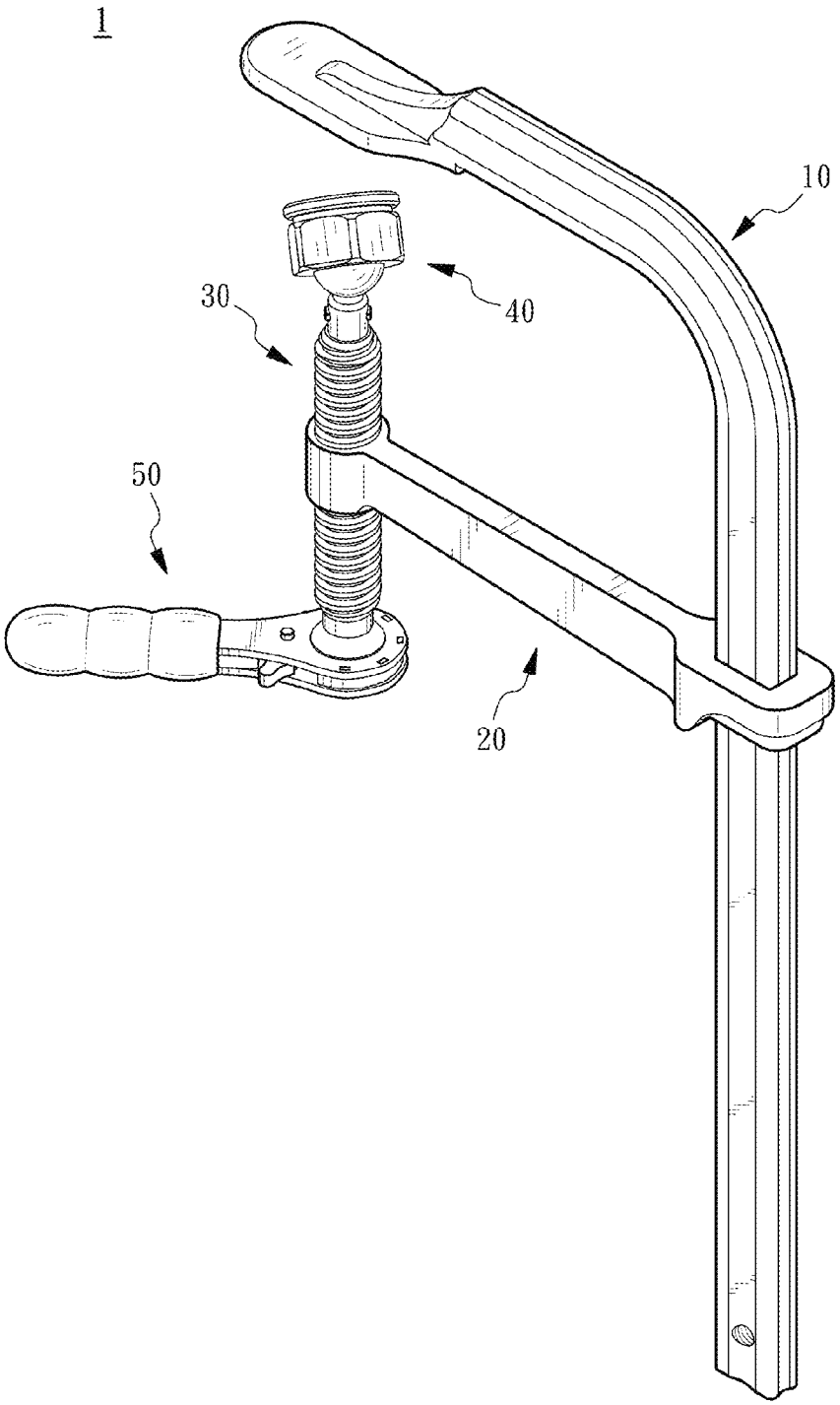
FIG. 1 is a perspective view of the clamp with ratchet device in accordance with the present invention.
Figure 2:
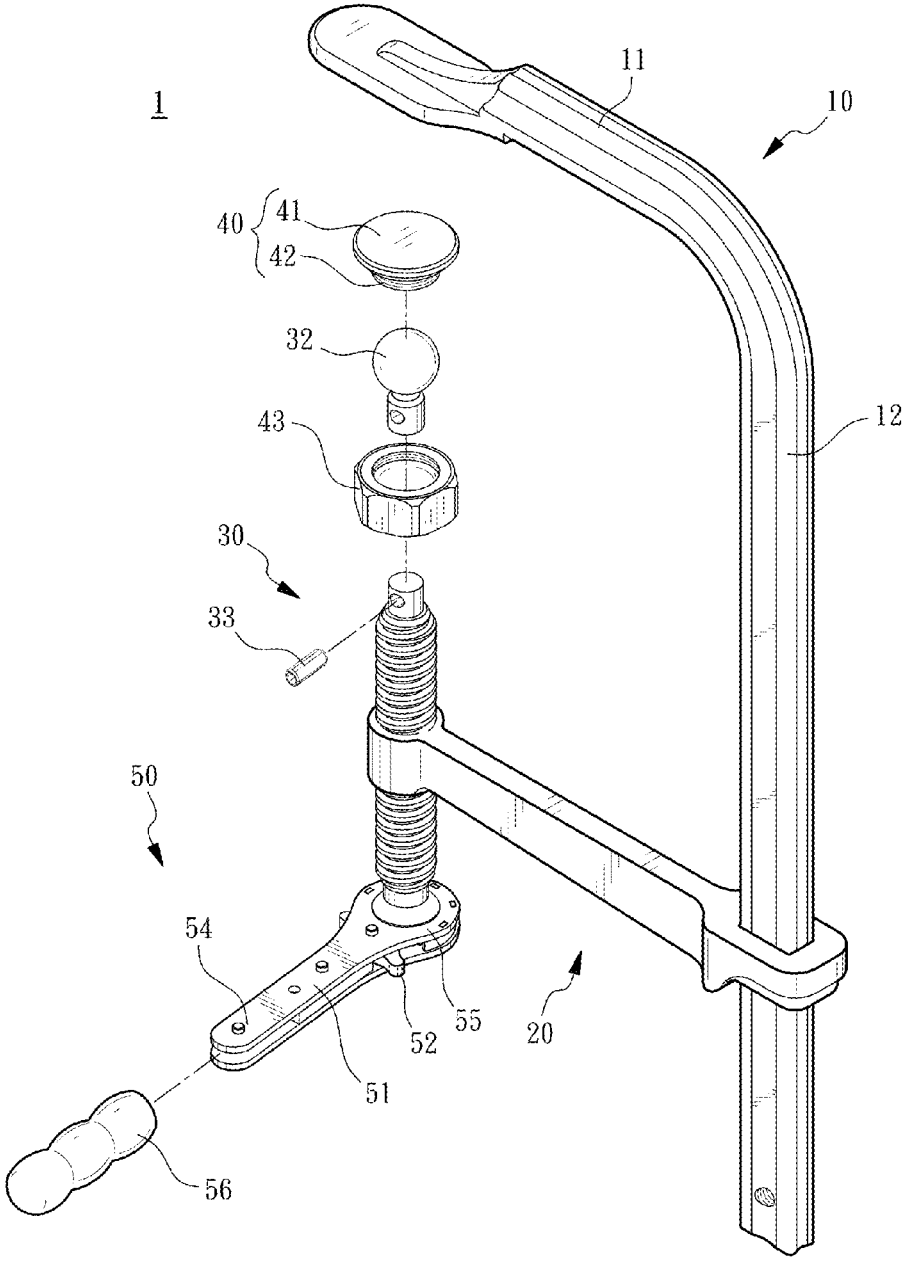
FIG. 2 is an exploded view of the clamp with ratchet device in accordance with the present invention.
Figure 3:
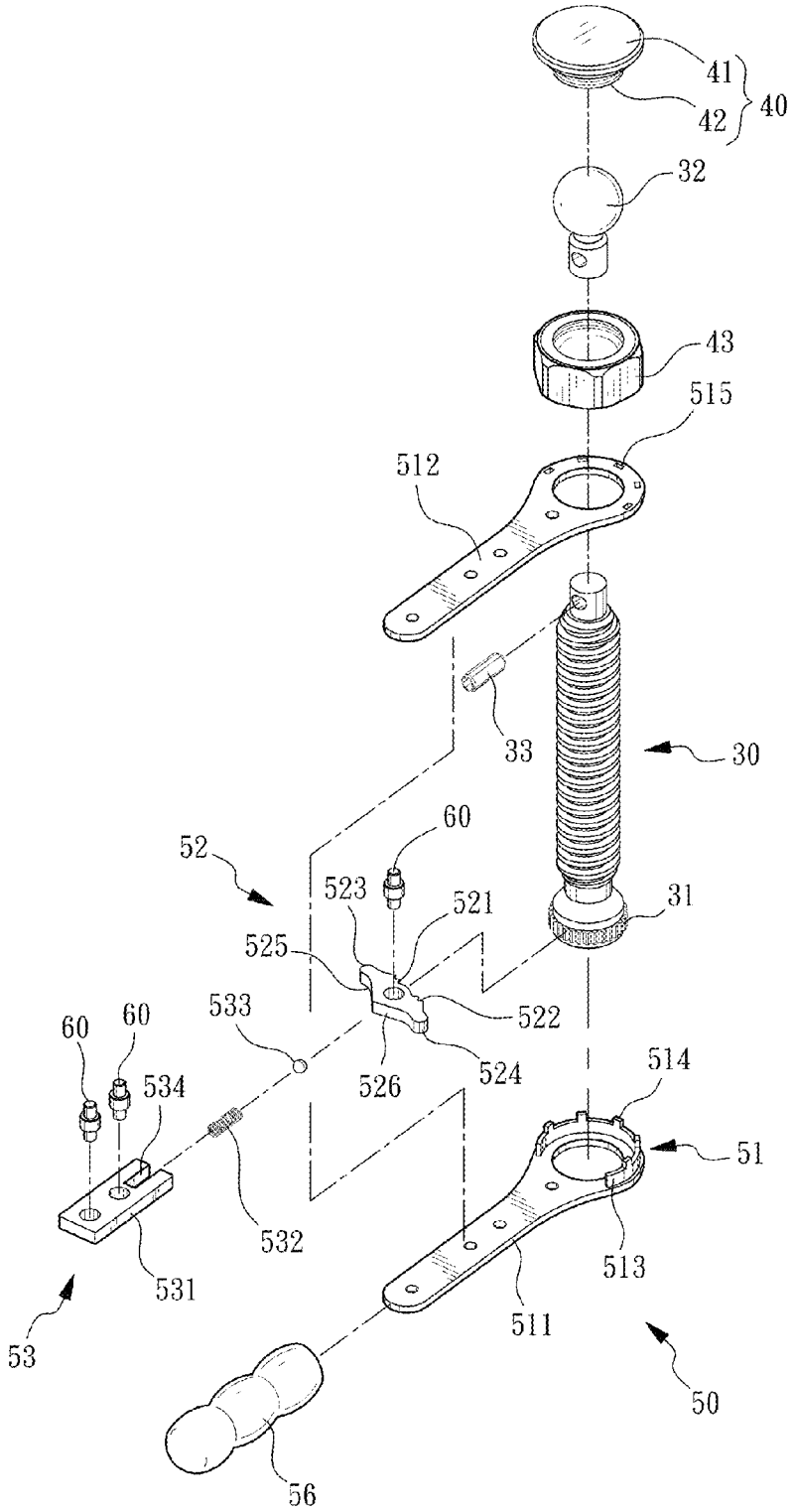
FIG. 3 is an exploded view illustrating the ratchet device of the present invention.
Figure 4:
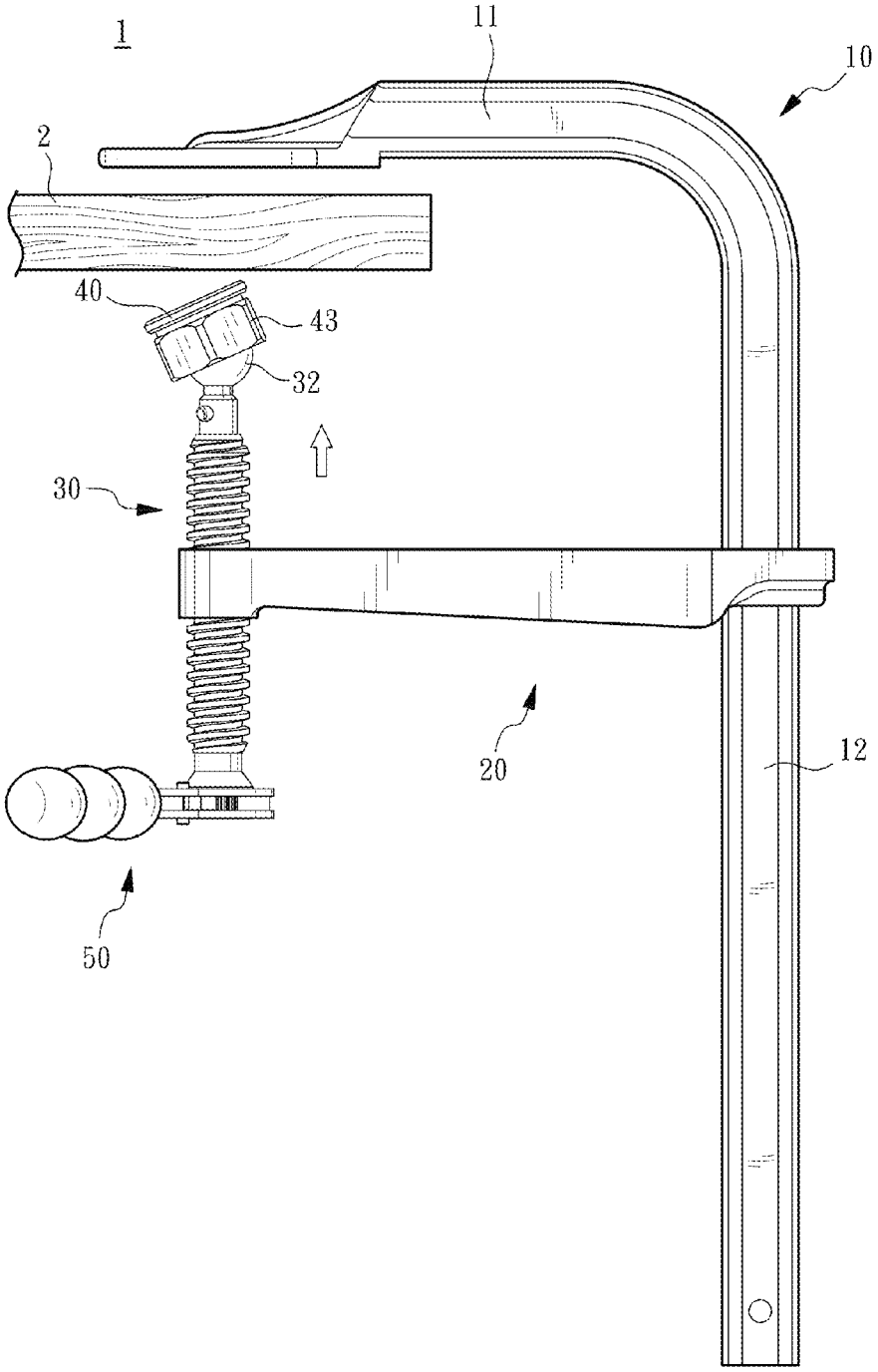
FIG. 4 is a schematic side view illustrating the clamp in a status before clamping a target object in accordance with the present invention.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 4, a clamp 1 with ratchet device of the present invention, as shown by the embodiment present as an F-clamp, comprises a clamp body 10, an installation part 20, a thread rod 30, a clamping member 40, and a ratchet device 50. The thread rod 30 is driven to move by the ratchet device 50, whereby the clamping member 40 and the clamp body 10 clamps a target object 2.

The clamp body 10 is in an L shape, having a fixed part 11, and a slide rail 12 disposed on one end of the fixed part 11, while the fixed part 11 and the slide rail 12 are integrally formed.

One end of the installation part 20 mounts around the slide rail 12, wherein the installation part 20 is able to slidingly move along the slide rail 12.

The thread rod 30 is movably disposed on the other end of the installation part 20, wherein the thread rod 30 is provided with a first end having a ratchet part 31 and a second end having a ball member 32 installed thereon through a fixing pin 33.

The clamping member 40 has one end provided with a clamping surface 41 and the other end provided with a thread 42, wherein the ball member 32 is provided with a nut 43 for being screwed with the thread 42, whereby the clamping member 40 is rotatably disposed on the second end of the thread rod 30 and capable of rotating by different angles thereon. Therefore, the clamping surface 41 cooperates with the fixed part 11 for clamping.

The ratchet device 50 is combined to the first end of the thread rod 30 and being operated between an idling position and a driving position. Therein, at the driving position, the ratchet device 50 drives the thread rod 30 to move forward or away from the fixed part 11; at the idling position, the ratchet device 50 idles against the thread rod 30. The ratchet device further comprises a main body 51 disposed in perpendicular to the thread rod 30, a ratchet block 52, and a positioning mechanism 53. The main body 51 is provided with a head part 55 disposed on the first end of the thread rod 30 and a grip part 54 extending from the head part 55, while the grip part 54 is sleeved by a protective sleeve 56. Furthermore, the main body 51 is formed by a first shaft 511 and a second shaft 512. The first shaft 511 is peripherally provided with a combining part 513 for correspondingly containing the ratchet part 31 of the thread rod 30, with plural coupling blocks 514 equidistantly disposed on the combining part 513. The second shaft 512 has plural coupling bores 515 for being correspondingly coupled with the coupling blocks 514.

The ratchet block 52 is pivotally disposed on the main body 51 and capable of swinging between a first position and a second position for driving the ratchet device 50 to be operated between the idling position and the driving position. Therein, the ratchet block 52 has a first tooth 521 and a second tooth 522 disposed with an interval therebetween. Furthermore, a first operational part 523 and a second operational part 524 are disposed on the lateral sides of the first and second teeth 521, 522, respectively, while the first and second operational parts 523, 524 protrude on the both sides of the main body 51, respectively. When the user turns up the first operational part 523 or the second operational part 524, the ratchet block 52 correspondingly swings between the first position and the second position, whereby the first tooth 521 and the second tooth 522 alternatively engages the ratchet part 31. In addition, a first contact part 525 and a second contact part 526 are disposed on one end of the ratchet block 52 opposite to the end provided with first and second teeth 521, 522, with an angle included between the first and second contact parts 525, 526. Therefore, the first and second contact parts 525, 526 form a V shape configuration.

The positioning mechanism 53 is disposed in the main body 51 for positioning the ratchet block 52 at the first or second positions. Therein, the positioning mechanism 53 comprises a fixing member 531, a spring 532, and a pushing member 533. The fixing member 531 is fixed on the grip part 54 of the main body 51, and the fixing member 531 comprises a recess 534 for receiving the spring 532. The pushing member 533, in the embodiment of the present invention, is a steel ball, disposed in the recess 534 and pushed by the spring 532, whereby the pushing member 533 pushes toward the first or second contact parts 525, 526, alternatively, for positioning the ratchet block 52.

Especially, the ratchet block 52 and the positioning mechanism 53 are disposed between the first shaft 511 and the second shaft 512, and positioned by plural pivot pins 60.

Figure 5:
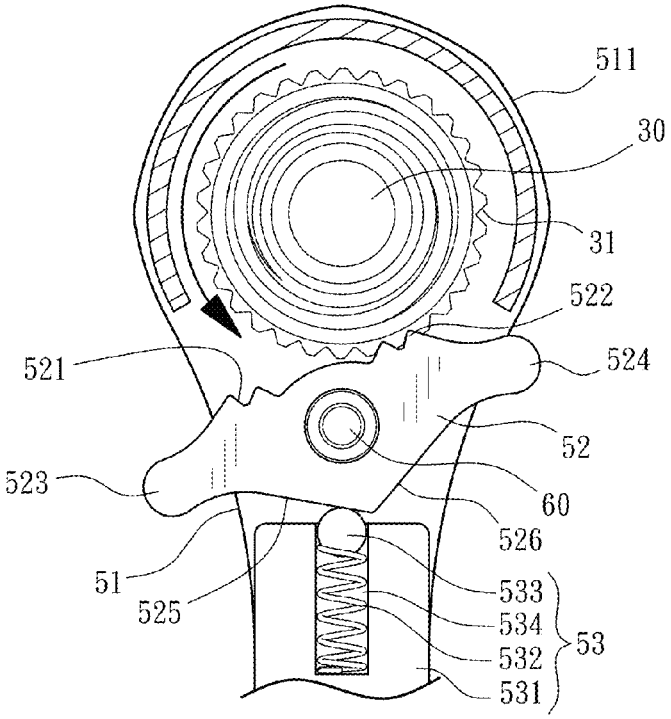
FIG. 5 is a schematic view illustrating the ratchet block at the first position in accordance with the present invention.

Referring to FIG. 5, the pushing member 533 of the positioning mechanism 53 pushes the first contact part 525, so that the first tooth 521 of the ratchet block 52 moves away from the ratchet part 31 of the thread rod 30, whereby the ratchet block 52 is at the first position, causing the second tooth 522 to engage the ratchet part 31. As a result, the main body 51 is allowed to be idling clockwise against the ratchet part 31 and around the axis of the thread rod 30; meanwhile, the main body 51 is allowed to drive the ratchet part 31 to rotate counterclockwise, thereby triggering the thread rod 30 to move.

Figure 6:
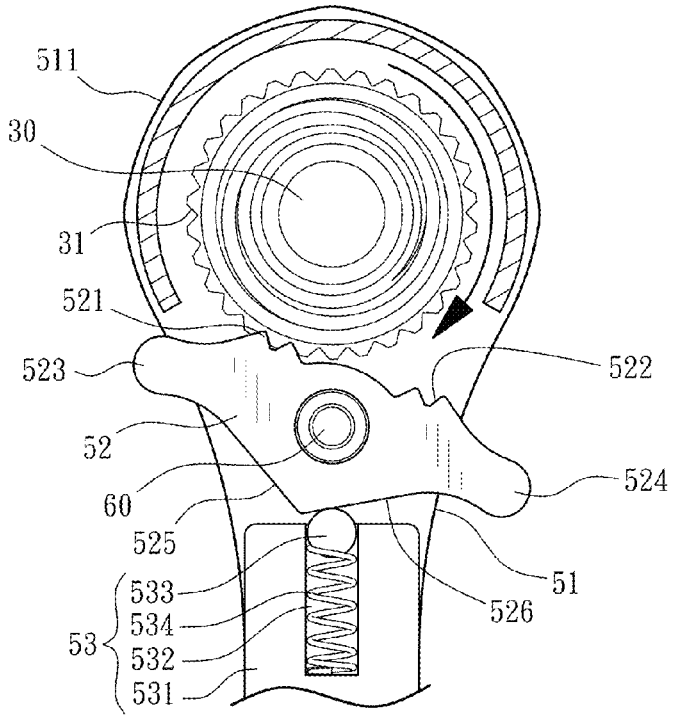
FIG. 6 is a schematic view illustrating the ratchet block at the second position in accordance with the present invention.

Referring to FIG. 6, based on the same method, when the ratchet block 52 is turned and moves from the first position to the second position, the pushing member 533 pushes the second contact part 526, causing the first tooth 521 of the ratchet block 52 to engage the ratchet part 31. As a result, the main body 51 is allowed to be idling counterclockwise against the ratchet part 31 and around the axis of the thread rod 30; meanwhile, the main body 51 is allowed to drive the ratchet part 31 to rotate clockwise, thereby triggering the thread rod 30 to move.

Figure 7:
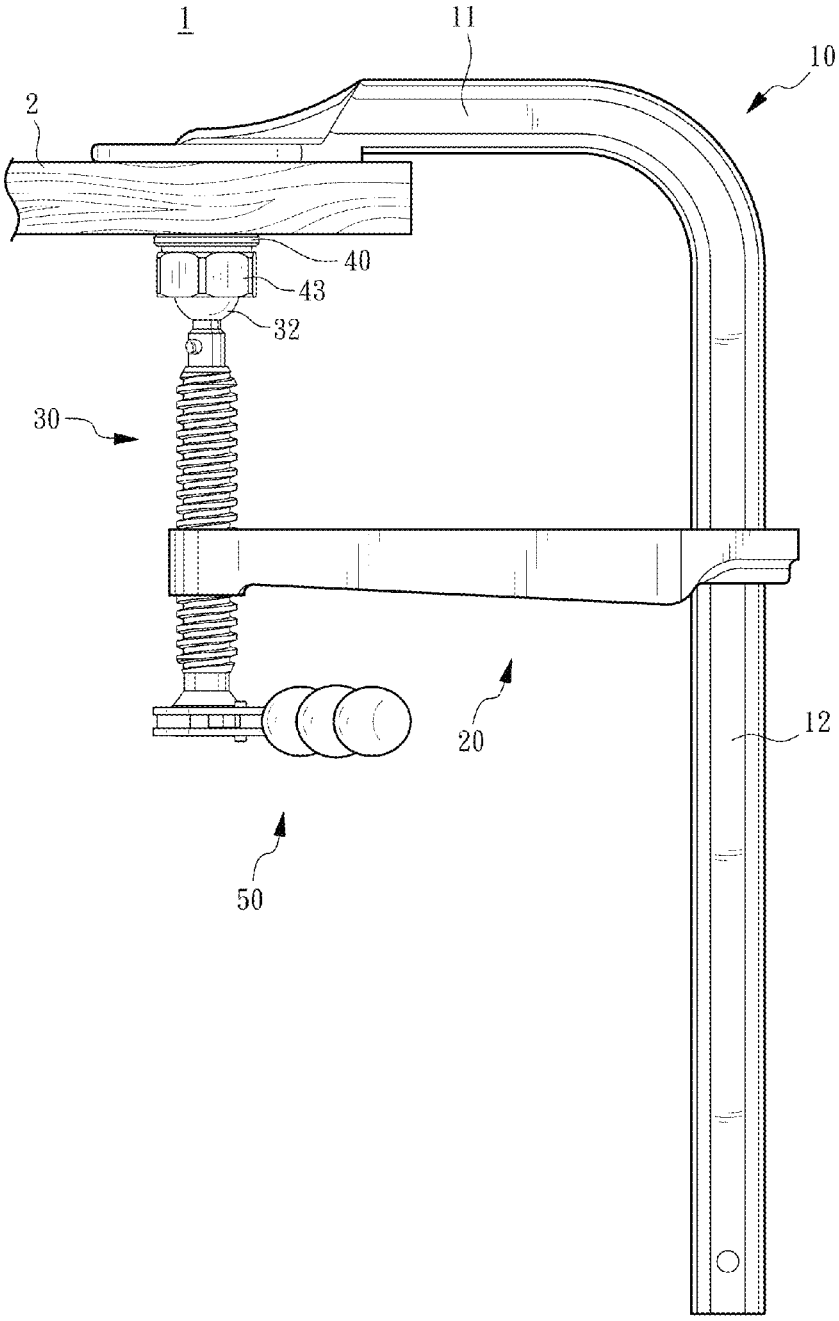
FIG. 7 is a schematic side view illustrating the clamp in a status after clamping a target object in accordance with the present invention.

Referring to FIG. 7, with the aforementioned configuration and method of operation, the ratchet device 50 is operated between the idling position and the driving position, thereby triggering the thread rod 30 to reciprocate and moves toward the fixed part 11, whereby the clamping member 40 and the fixed part 11 cooperate to clamp the target object 2. Therefore, an operation in a narrow space is allowed, and the convenience of operation is enhanced.

Furthermore, the ratchet device 50 is combined to the first end of the thread rod 30, and the section from the edge of the grip part 54 of the main body 51 to the axis of the thread rod 30 is defined as a force exertion arm. When the user grips the grip part 54 for driving the thread rod 30, the torque value for driving the thread rod 30 to rotate equals to the product of the force exerted multiplied by the length of the force exertion arm. When the force exerted by the user is greater, the torque thus produced is greater, whereby the thread rod 30 efficiently drives the clamping member 40 to push toward the target object 2, and the clamping force is increased for stably clamping the target object 2. Therefore, force exertion of the present invention is not limited by the space limitation; at the same time, the thread rod 30 is driven to rotate by the ratchet device 50, thereby triggering the clamping member 40 to slide toward the fixed part 11 for pressing the target object 2, thus stably clamping the target object 2.

Figure 8:
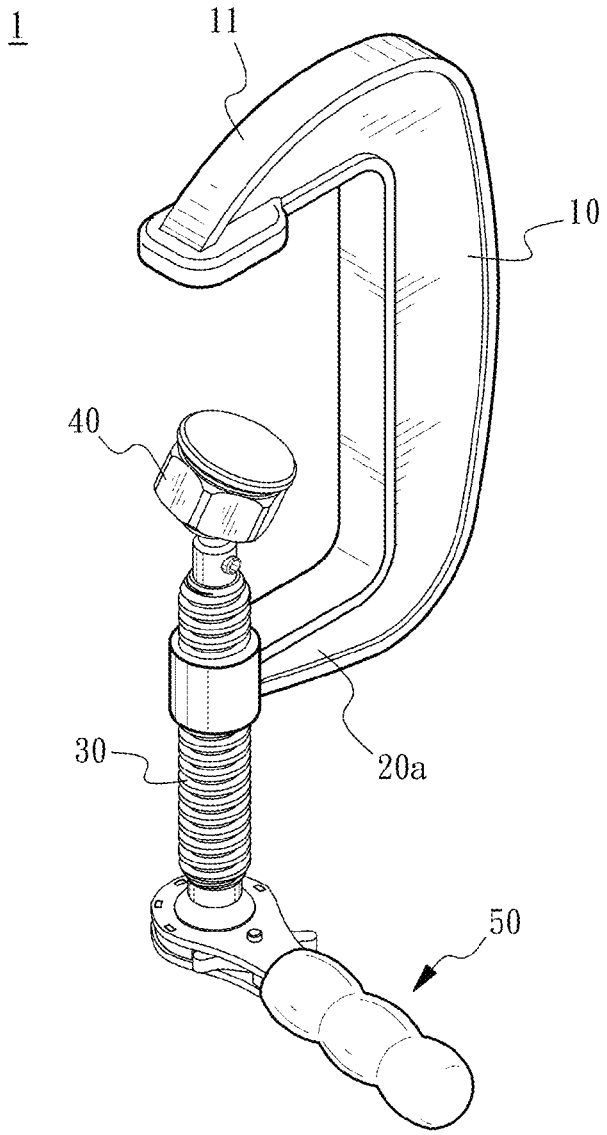
FIG. 8 is a perspective view of another embodiment provided in accordance with the present invention.
Figure 9:
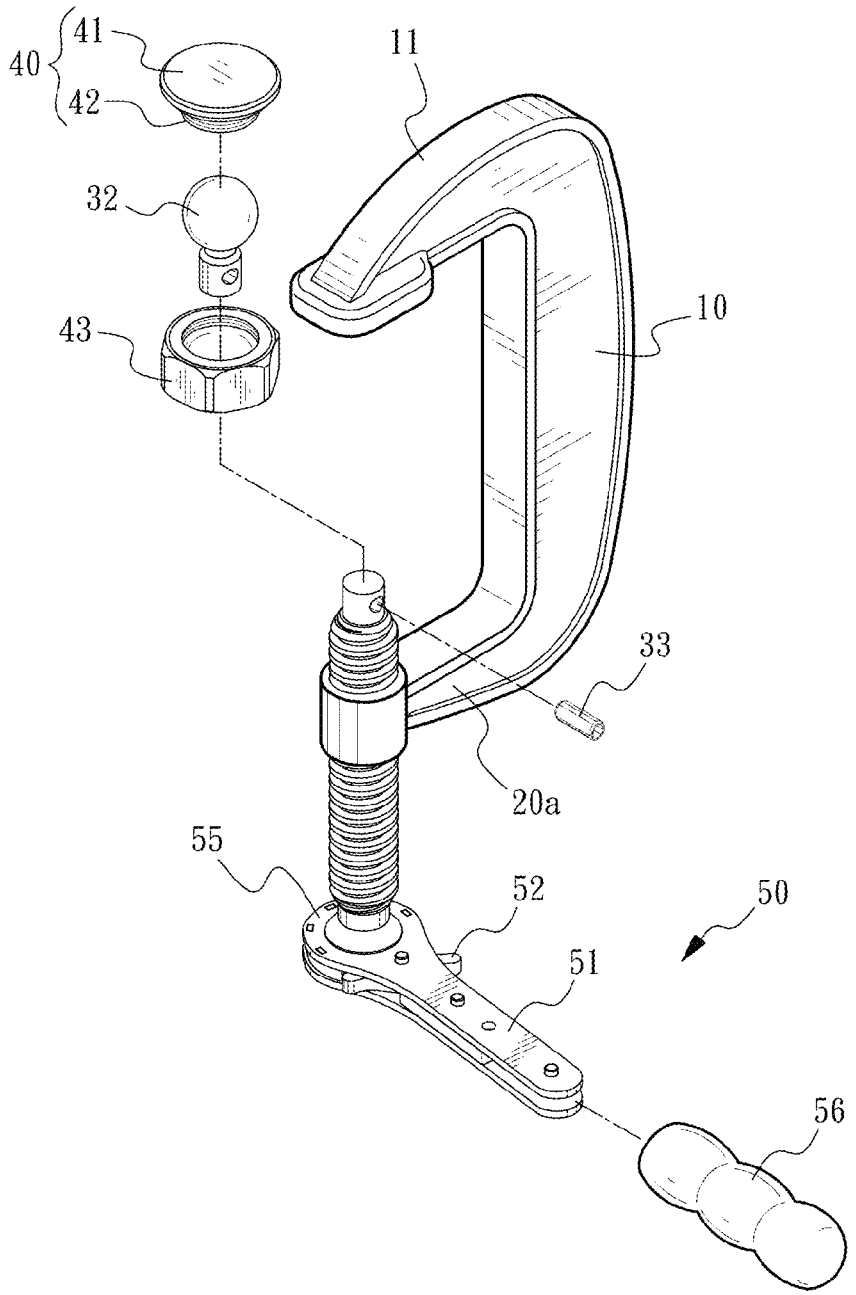
FIG. 9 is an exploded view of the embodiment of FIG. 8 in accordance with the present invention.

Referring to FIG. 8 and FIG. 9 illustrating another embodiment provided by the present invention, the clamp 1 in such embodiment is a C-clamp, wherein an installation part **20*a* is integrally disposed on the clamp body 10 on the opposite side of the fixed part 11, and the thread rod 30 is movably disposed on the installation part 20*a*. Therefore, the ratchet device 50 is combined to the first end of the thread rod 30 for driving the thread rod 30 to rotate, so that the clamping member 40 moves toward the fixed part 11**, thereby clamping a target object.

To conclude, with the operation of the ratchet device 50 of the present invention, the force is able to be efficiently exerted and the operation of the present invention is accelerated, whereby the target object is effectively clamped.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A clamp with ratchet device for clamping a target object, comprising:

a clamp body, provided with a fixed part and a corresponding installation part;

a thread rod, movably disposed on the installation part and having a first end and a second end;

a clamping member, disposed on the second end of the thread rod; and a ratchet device, combined to a first end of the thread rod, and allowed to be operated between an idling position and a driving position, wherein the ratchet device is able to drive the thread rod to rotate and move toward and away from the fixed part at the driving position, and also is able to be idling against the thread rod at the idling position.

2. The clamp of claim 1, wherein the ratchet device, at the idling position, idles around the axis of the thread rod.

3. The clamp of claim 1, wherein one end of the fixed part is provided with a slide rail, with the installation part mounting around the slide rail and capable of slidingly moving thereon.

4. The clamp of claim 1, wherein the installation part is integrally disposed on the clamp body.

5. The clamp of claim 1, wherein the first end of the thread rod is provided with a ratchet part, while the ratchet device is provided with a ratchet block for engaging the ratchet part.

6. The clamp of claim 5, wherein the ratchet device further comprises a main body, with the ratchet block pivotally disposed on the main body and capable of swinging between a first position and a second position for facilitating the ratchet device being operated between the idling position and the driving position.

7. The clamp of claim 6, wherein the ratchet block is provided with a first tooth and a second tooth for engaging the ratchet part at the second position and the first position, respectively.

8. The clamp of claim 6, wherein the ratchet block is provided with a first operational part and a second operational part protruding from two sides of the main body, respectively.

9. The clamp of claim 6, wherein the ratchet device further comprises a positioning mechanism for optionally positioning the ratchet block at the first position and the second position.

10. The clamp of claim 9, wherein a first contact part and a second contact part are disposed on one end of the ratchet block opposite to the end provided with the first tooth and the second tooth, while the positioning mechanism comprises a pushing member resiliently pushing the first contact part or the second contact part for optionally positioning the ratchet block at the first position or the second position.

11. The clamp of claim 10, wherein an angle is included by the first contact part and the second contact part.

12. The clamp of claim 10, wherein the positioning mechanism further comprises a fixing member fixed on the main body, and the fixing member has a recess for receiving a spring, while the spring pushes the pushing member toward the first contact part or the second contact part.

13. The clamp of claim 12, wherein the main body is formed by a first shaft and a second shaft.

14. The clamp of claim 13, wherein the first shaft is peripherally provided with a combining part for correspondingly containing the ratchet part, and the combining part is equidistantly provided with plural coupling blocks, while the second shaft is provided with plural coupling bores for being correspondingly coupled with the coupling blocks.

15. The clamp of claim 6, wherein the main body is provided with a grip part and a head part, while the head part is disposed for correspondingly receiving the ratchet part of the thread rod.

16. The clamp of claim 15, wherein the grip part is sleeved by a protective sleeve.

17. The clamp of claim 1, wherein the clamping member is rotatably disposed on the second end of the thread rod and capable of rotating by different angles thereon.

18. The clamp of claim 17, wherein the second end of the thread rod is provided with a ball member, while the ball member has a nut for being screwed with the clamping member, whereby the clamping member is rotatably disposed on the ball member.

19. A clamp with ratchet device for clamping a target object, comprising:

a clamp body, provided with a fixed part and a corresponding installation part;

a thread rod, movably disposed on the installation part and having a first end and a second end;

a clamping member, disposed on the second end of the thread rod; and a ratchet device, provided with a main body having a head part and a grip part extending from the head part, with the head part combined to a first end of the thread rod, while the ratchet device is allowed to be operated between an idling position and a driving position, wherein the ratchet device is able to drive the thread rod to rotate and move toward and away from the fixed part when the ratchet device is at the driving position, and the grip part is allowed to be idling against the axis of the thread rod when the ratchet device is at the idling position.

20. The clamp of claim 19, wherein the first end of the thread rod is provided with a ratchet part, and a ratchet block is pivotally disposed on the main body for engaging the ratchet part, while the ratchet block is capable of swinging between a first position and a second position for facilitating the ratchet device being operated between the idling position and the driving position.

21. The clamp of claim 20, wherein the ratchet block is provided with a first tooth and a second tooth for engaging the ratchet part at the second position and the first position, respectively.

22. The clamp of claim 20, wherein the ratchet block is provided with a first operational part and a second operational part protruding from two sides of the main body, respectively.

23. The clamp of claim 20, wherein the ratchet device further comprises a positioning mechanism for optionally positioning the ratchet block at the first position and the second position.

24. The clamp of claim 19, wherein one end of the fixed part is provided with a slide rail, with the installation part mounting around the slide rail and capable of slidingly moving thereon.

25. The clamp of claim 19, wherein the installation part is integrally disposed on the clamp body.

* * * * *